United States Patent [19]

Ohe et al.

[11] Patent Number: 4,794,397

[45] Date of Patent: Dec. 27, 1988

[54] AUTOMOBILE ANTENNA

[75] Inventors: Junzo Ohe; Hiroshi Kondo, both of Aichi, Japan

[73] Assignee: Toyota Jidosha Kabushiki Kaisha, Toyota, Japan

[21] Appl. No.: 786,865

[22] Filed: Oct. 11, 1985

[30] Foreign Application Priority Data

Oct. 13, 1984 [JP] Japan ..... 59-214972

[51] Int. Cl.[4] ..... H01Q 1/32

[52] U.S. Cl. ..... 343/712; 343/842

[58] Field of Search ..... 343/711, 712, 713, 743, 343/841, 842, 741

[56] References Cited

U.S. PATENT DOCUMENTS

| | | | |
|---|---|---|---|
| 2,200,644 | 5/1940 | McDonald | 343/866 |
| 2,212,253 | 8/1940 | Stief | 343/712 |
| 2,404,093 | 7/1946 | Roberts | 343/708 |
| 2,474,794 | 6/1949 | Van Beuren | 343/842 |
| 2,481,978 | 9/1949 | Clough | 343/712 |
| 2,520,986 | 9/1950 | Williams et al. | 343/712 |
| 2,575,471 | 11/1951 | Schweiss et al. | 343/712 |
| 2,740,113 | 3/1956 | Hemphill | 343/787 |
| 2,774,811 | 12/1956 | Shanok et al. | 343/712 |
| 2,859,441 | 11/1958 | Rosenbaum | 343/712 |
| 2,950,479 | 8/1960 | Pan | 343/702 |
| 2,971,191 | 2/1961 | Davis | 343/712 |
| 3,007,164 | 10/1961 | Davis | 343/712 |
| 3,066,293 | 11/1962 | Davis | 343/767 |
| 3,210,766 | 10/1965 | Parker | 343/743 |
| 3,364,487 | 1/1968 | Maheux | 343/702 |
| 3,566,133 | 1/1968 | Rambo | 455/277 |
| 3,611,388 | 10/1971 | Okumura | 343/712 |
| 3,717,876 | 2/1973 | Volkers et al. | 343/712 |
| 3,728,732 | 4/1973 | Igarashi | 343/713 |
| 3,742,508 | 6/1973 | Tomaszewski | 343/713 |
| 3,794,997 | 2/1974 | Iwatsuki et al. | 343/712 |
| 3,823,403 | 7/1974 | Walter et al. | 343/708 |
| 3,916,413 | 10/1975 | Davis | 343/712 |
| 3,961,292 | 6/1976 | Davis | 343/712 |
| 3,961,330 | 6/1976 | Davis | 343/712 |
| 3,972,048 | 7/1976 | Davis | 343/712 |
| 4,003,056 | 6/1977 | Davis | 343/713 |
| 4,080,603 | 3/1978 | Moody | 343/712 |
| 4,217,591 | 8/1980 | Czerwinski | 343/713 |
| 4,278,980 | 7/1981 | Ogita et al. | 343/748 |
| 4,317,121 | 2/1982 | Allen et al. | 343/712 |
| 4,339,827 | 7/1982 | Torres et al. | 455/188 |
| 4,499,606 | 2/1985 | Rambo | 455/277 |
| 4,506,267 | 3/1985 | Harmuth | 343/744 |
| 4,633,519 | 12/1986 | Gotoh et al. | 455/277 |
| 4,707,701 | 11/1987 | Ohe et al. | 343/712 |
| 4,717,922 | 1/1988 | Ohe et al. | 343/712 |

FOREIGN PATENT DOCUMENTS

| | | | |
|---|---|---|---|
| 181765 | 5/1986 | European Pat. Off. . | |
| 181200 | 5/1986 | European Pat. Off. . | |
| 181120 | 5/1986 | European Pat. Off. . | |
| 182497 | 5/1986 | European Pat. Off. . | |
| 183443 | 5/1986 | European Pat. Off. . | |
| 183520 | 6/1986 | European Pat. Off. . | |
| 183523 | 6/1986 | European Pat. Off. . | |
| 889618 | 9/1953 | Fed. Rep. of Germany . | |
| 1131762 | 6/1962 | Fed. Rep. of Germany . | |
| 1949828 | 4/1970 | Fed. Rep. of Germany . | |
| 7015306 | 9/1970 | Fed. Rep. of Germany . | |
| 2425189 | 12/1974 | Fed. Rep. of Germany . | |
| 2701921 | 7/1978 | Fed. Rep. of Germany . | |
| 2745475 | 4/1979 | Fed. Rep. of Germany | 343/712 |
| 2821202 | 11/1979 | Fed. Rep. of Germany . | |
| 2733478 | 4/1980 | Fed. Rep. of Germany . | |
| 53-022418 | 7/1978 | Japan . | |
| 53-34826 | 8/1978 | Japan . | |
| 59-44861 | 9/1982 | Japan . | |
| 60-129464 | 2/1984 | Japan . | |

OTHER PUBLICATIONS

Japanese Abstracts, vol. 6, No. 55E-101, 4/10/82, 56-168441.

Japanese Abstracts, vol. 6, No. 37E-97, 3/6/82, 56-156031.

Japanese Abstracts, vol. 7, No. 167, 7/15/83, 58-70642.

Japanese Abstracts, vol. 7, No. 162, E-187, 7/15/83, 58-70640.

*Primary Examiner*—William L. Sikes

*Assistant Examiner*—Michael C. Wimer

*Attorney, Agent, or Firm*—Cushman, Darby & Cushman

[57] ABSTRACT

An automobile antenna system for receiving various broadcast and communication waves without pole antennas projected from an automobile body. The system comprises a high-frequency pickup arranged along the length of a trunk hinge on the vehicle body to detect high-frequency surface currents which are induced on the vehicle body by broadcast waves and which are concentrated onto the trunk hinge.

3 Claims, 5 Drawing Sheets

AUTOMOBILE ANTENNA

BACKGROUND OF THE INVENTION

1. Field of the Invention

The present invention relates to an automobile antenna system and particularly to an improved automobile antenna for effectively receiving and detecting broadcast waves at the vehicle body to feed detection signals to various receivers which are internally located in the vehicle body.

2. Description of the Prior Art

Antenna systems are essential for modern automobiles which positively receive various broadcast and communication waves to be supplied to various inboard receivers such as radios, televisions, telephones and the like. Such antenna systems also are very important as for transmission and reception of civil band waves to communicate an automobile with other sources of radio waves.

One of the conventional well-known antenna systems is in the form of a pole antenna protruded outwardly from the vehicle body, which has some preferred performances in its receiving characteristics, but which is disadvantageous in that the pole antenna may spoil the aesthetic appearance of the automobile.

Indeed, such a pole antenna is subject to damage and mischief and also tends to produce unpleasant noises when a vehicle runs at high speeds.

Recently, the number of frequency bands of broadcast or communication waves to be received at by automobiles has been increased. When one wishes to receive a plurality of frequency band waves, the corresponding number of antennas are required which may degrade the aesthetic appearance of an automobile. Some electrical interference may be raised between these antennas, leading to very a reduction of reception performance.

Some attempts have been made to provide an invisible antenna in place of the pole antenna. One such attempt is that an antenna wire is applied to the rearwindow glass of an automobile.

Another attempt has been made in which there is provided means for detecting surface currents induced on the vehicle body by broadcast waves. Although such a proposal appears to provide a positive and efficient means for receiving broadcast waves at an automobile, experiments show that it is unsuccessful.

Firstly, the unsuccessful means utilizing the surface currents induced on the vehicle body by broadcast waves results from the fact that the value of surface current is not large against expectation. Even when the surface currents induced in the roof panel of the vehicle body were utilized, one could not obtain sufficient levels of available detection output.

Secondly, the surface currents included noises in very large proportion. Such noises result mainly from the engine ignition system and battery charging regulator system and cannot be removed from the surface currents while the engine runs.

Still another attempt is disclosed in Japanese Patent Publication Sho No. 53-22418 in which an antenna system utilizing currents induced on a vehicle body by broadcast waves comprises an electrical insulation portion formed at the current concentration portion of the vehicle body and a sensor for directly detecting currents between the opposite ends of the electrical insulation portion. This antenna system exhibits a superior performance that practicable detection signals superior in SN ratio can be obtained. However, the antenna system includes a pickup structure which requires provision of a notch formed in part of the vehicle body. This cannot easily be accepted by manufacturers who produce automobiles in mass-production.

Japanese Utility Model Publication Sho No. 53-34826 discloses an antenna system comprising a pickup coil for detecting currents on the pillar structure of a vehicle body. This is advantageous in that the antenna can internally be mounted in the vehicle body. It is however impracticable that the pickup coil is located adjacent to the pillar in a direction perpendicular to the longitudinal axis thereof. Moreover, such arrangement cannot provide any practicable output from the antenna.

SUMMARY OF THE INVENTION

It is therefore an object of the present invention to provide an improved automobile antenna system which can efficiently detect currents induced on the vehicle body by broadcast waves and positively transmit the detected currents to an inboard receiver.

Since the prior art antenna systems intended to mainly receive AM band waves, the antenna systems for detecting vehicle body currents could not receive broadcast waves well due to the fact that the wavelength of the broadcast waves is too long. We aimed at this dependency of frequency and found that the vehicle body currents could very efficiently be utilized on receiving broadcast waves ranged in FM frequency bands, that is, normally 50 MHz or above.

We also aimed at the fact that the value of such high-frequency body currents is very different from one location to another on the vehicle body. Therefore, the present invention is characterized by a high-frequency pickup arranged at a location on the vehicle body at which noises are hardly picked up and in which currents having higher densities are induced by broadcast waves. In one aspect of the present invention, such desirable location includes trunk hinges on the vehicle body.

The present invention is further characterized in that the high-frequency pickup is disposed along the surface of a trunk hinge to positively detect a high-frequency current ranged in the aforementioned frequency bands. The pickup structure may be in the form of a loop antenna for electromagnetically detecting a magnetic flux generated by vehicle body currents. The pickup may also be in the form of electrode means for forming an electrostatic capacity between the electrode means and the trunk hinge such that high-frequency signals can electrostatically be detected.

DESCRIPTION OF PREFERRED EMBODIMENTS

Preferred embodiments of the present invention will now be described with reference to the accompanying drawings.

FIGS. 4 through 9 illustrate a process for measuring the distribution of high-frequency currents to determine a location on the vehicle body at which an antenna system is most efficient in operation.

Figure 4:
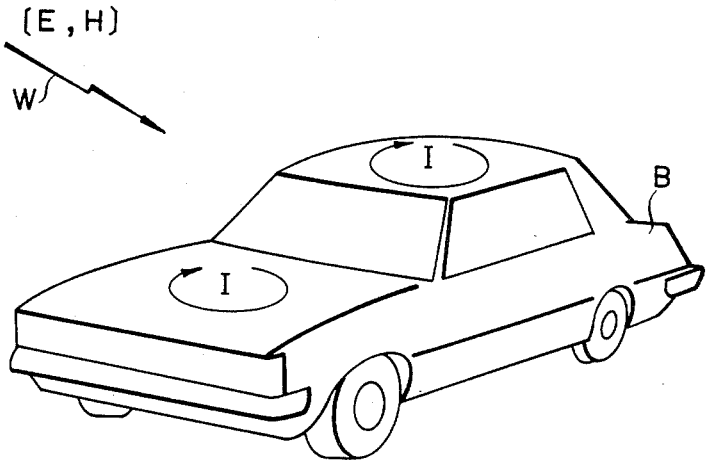
FIG. 4 illustrates surface currents I induced on a vehicle body B by external electromagnetic waves W.

FIG. 4 shows that when external electromagnetic waves W such as broadcast waves pass through a vehicle body B of conductive metal, the corresponding surface currents I are induced at locations on the vehicle body depending on the intensity of the electromagnetic waves. The present invention intends only relatively high frequency bands in excess of 50 MHz which are used in the field of FM broadcasting, television and the like.

The present invention is characterized by pickup means for such particular high-frequency bands, which is disposed at a location where the surface currents are increased in density and where less noise is produced, said pickup being used to measure the distribution of induced currents on the vehicle body.

Actual intensities of currents at various locations are simulated and measured through a computer to know the distribution of surface currents. For this end, the present invention utilizes a probe used based on the same principle as that of the high-frequency pickup disposed at the desired location on the vehicle body as will be described hereinafter. This probe is moved through the entire surface of the vehicle body to various location thereon to measure surface currents.

Figure 5:
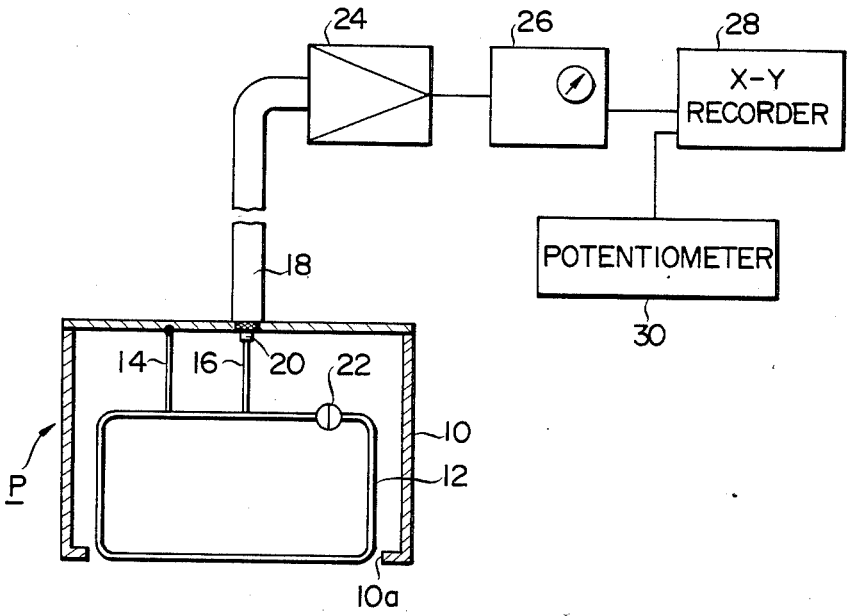
FIG. 5 is a block diagram illustrating a probe for determining the distribution of the body surface currents and which is similar to the high-frequency pickup used in the present invention, and its processing circuit.

FIG. 5 shows such a probe P that is constructed in accordance with the principle of the high-frequency pickup of the present invention as will be described. The probe P comprises a loop coil 12 fixedly mounted within a case 10 of conductive material to avoid external electromagnetic waves. The case 10 is provided with an opening 10*a* through which part of the loop coil 12 is externally exposed. The exposed part of the loop coil 12 is located adjacent to the surface of the vehicle body B to detect a magnetic flux induced by the surface currents on the vehicle body. Part of the loop coil 12 is connected with the case 10 through a short-circuiting wire 14. The output terminal 16 of the loop coil 12 is connected with a core 20 of a coaxial cable 18. The loop coil 12 is provided with a capacitor 22 which causes the frequency of the loop coil 12 to resonate with the desired frequency to be measured. This increases the efficiency in the pickup.

When the probe P is moved through the surface of the vehicle body B and angularly rotated at various points of measurement, the distribution and orientation of the surface currents on the vehicle body surface can accurately be determined. In the arrangement of FIG. 5, the output of the probe P is amplified by a high-frequency voltage amplifier 24 the output voltage of which is measured by a high-frequency voltmeter 26. The output voltage of the coil is visually read at the voltmeter 26 and also recorded by an XY recorder 28 as the distribution of surface currents at various locations on the vehicle body. The input of the XY recorder 28 receives signals indicative of various locations on the vehicle body from a potentiometer 30 such that high-frequency surface currents at the various location can be known.

Figure 6:
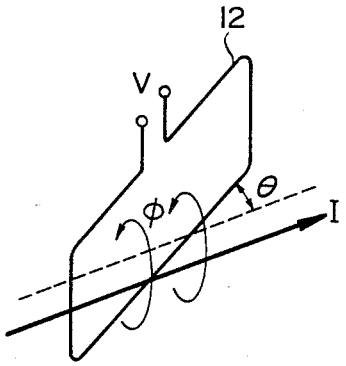
FIG. 6 illustrates the electromagnetic coupling condition between the surface currents I and the pickup loop antenna.
Figure 7:
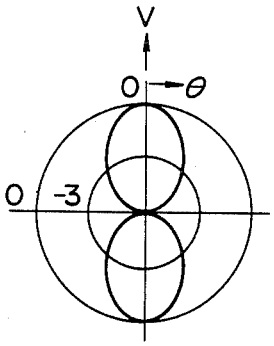
FIG. 7 illustrates a directional pattern in the loop antenna shown in FIG. 6.

FIG. 6 shows an angle of deviation $\theta$ between the high-feequency surface current I and the loop coil 12 of said pickup. As shown, the magnetic flux $\phi$ induced by the current I intersects the loop coil 12 to generate a detection voltage V in the loop coil 12. When the angle of deviation $\theta$ becomes zero, that is, when the surface current I becomes parallel to the loop coil 12 as shown in FIG. 7, the maximum voltage can be obtained. Therefore, one can know the orientation of the surface current I when the maximum voltage at each of the locations is obtained by rotating the probe P.

Figure 8:
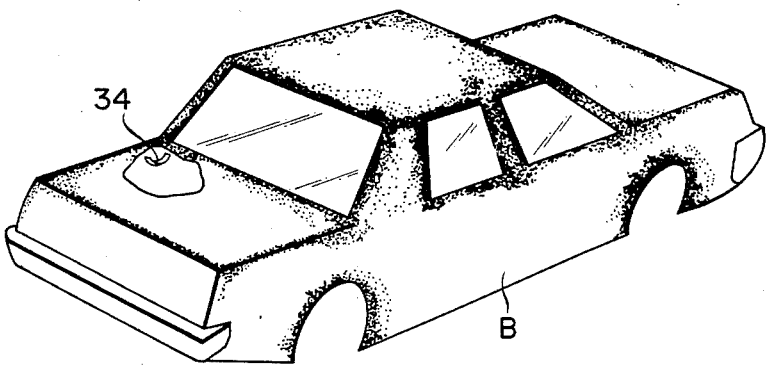
FIG. 8 illustrates the distribution of intensity in surface currents.
Figure 9:
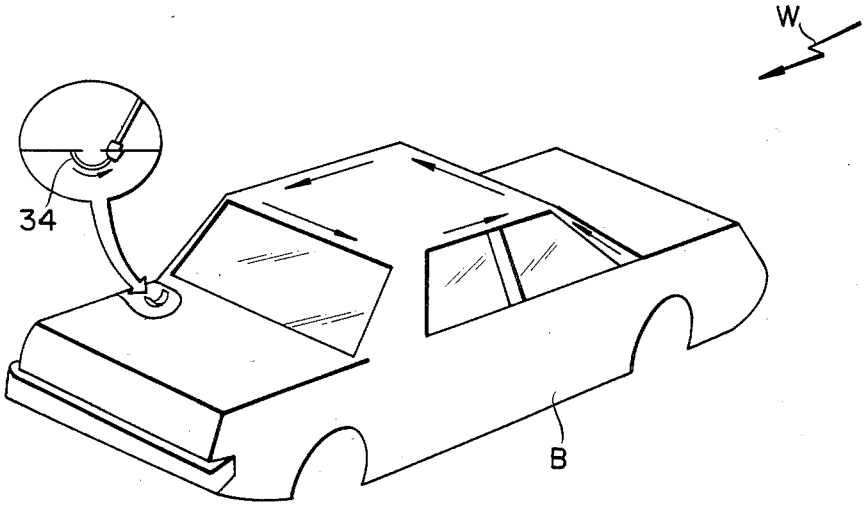
FIG. 9 illustrates the orientation of surface currents.

FIGS. 8 and 9 show the amplitude and orientation of high-frequency surface currents at various locations on the vehicle body, at the frequency of 80 MHz, which are determined from the measurements of the probe P and from the simulation of the computer. As will be apparent from FIG. 8, the amplitude of the surface current becomes high along the flat edges of the vehicle body and on the contrary becomes very low at the entral portion of the flat vehicle panel.

It is also understood from FIG. 9 that the currents concentrate in the directions parallel to the edges of the vehicle body or along the connections of the flat panels.

Such a distribution of current density also indicates the fact that the density of the concentrating surface currents becomes higher at various hinges between the vehicle body and an engine hood, trunk lid or door in addition to the external surface of the vehicle body B. We aimed at the trunk hinge among them.

As will be apparent from the drawings, surface currents having a density equal to or more than those at the other locations flow in the trunk hinge in FM frequency bands. This tendency increases as the value of frequency is increased. This shows the fact that currents can be detected from the trunk hinge which was substantially ignored in the prior art for AM broadcast bands.

Since the trunk hinge is farther remote from an engine, it is hardly affected by any noise from the vehicle body. The thus detected currents exhibit superior SN ratios.

Figure 1:
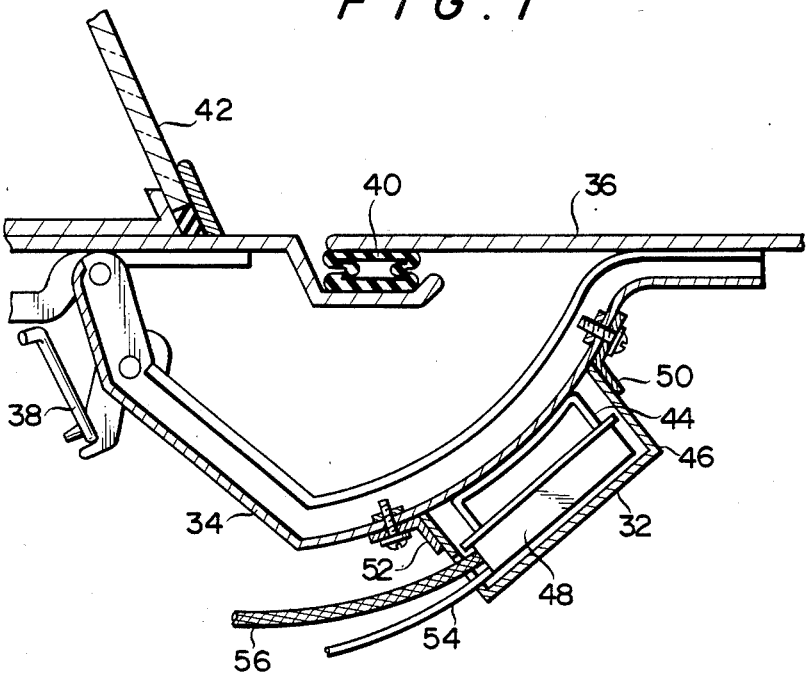
FIG. 1 is a cross-sectional view showing the primary parts of a preferred embodiment of an automobile antenna system according to the present invention, its high-frequency pickup being shown as an electromagnetic coupling type loop antenna mountdd on the trunk hinge of a vehicle body.
Figure 2:
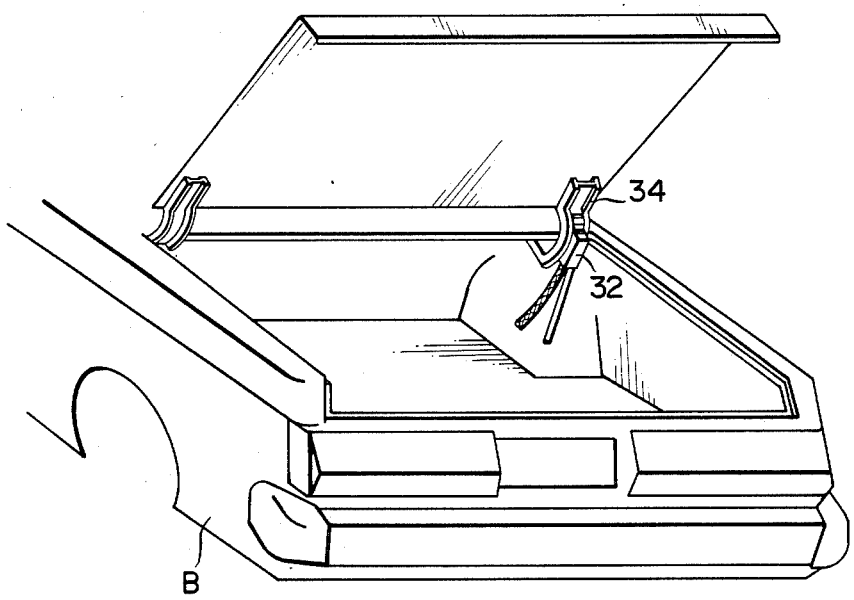
FIG. 2 is a schematically perspective view of the mounting of the pickup shown in FIG. 1.

FIG. 2 shows the first embodiment of the present invention in which a high-frequency pickup is fixedly mounted on a trunk hinge. The details of this embodiment are shown in FIG. 1. The high-frequency pickup 32 may be in the form of an electromagnetic coupling type pickup and has a construction similar to the probe including the loop coil used to determine the distribution of surface currents on the vehicle body as described hereinbefore.

Trunk hinge 34 is supported at one end by the vehicle body with the other end being fixedly mounted on a trunk lid 36 to provide means for supporting the rotating shaft of the trunk lid 36. The end of the trunk hinge 34 which is supported by the vehicle body is provided with a torsion bar 38 serving as a stop when the trunk lid 36 is opened. As is well-known in the art, a sealing weather strip 40 is provided between the trunk lid 36 and the vehicle body to prevent rainwater incoming through a rearwindow glass 42.

In the embodiment of the present invention shown in FIG. 1, the high-frequency pickup 32 is located outwardly along the longitudinal axial of the trunk hinge 34 or within the trunk room. The pickup 32 includes a loop antenna 44 disposed therein, which is arranged such that the longitudinal axis of the loop antenna 44 is aligned with the longitudinal axis of the trunk hinge 34. Thus, surface currents flowing in the trunk hinge 34 can positively and more efficiently be caught by the loop antenna 44.

The high-frequency pickup 32 includes a case 46 of electrically conductive material within which the loop antenna 44 and circuitry 48 including a pre-amplifier nnd others are mounted. The opening of the case 46 is directed to the trunk hinge 34. The opposite opening ends of the case 46 fixedly support L-shaped fittings 50 and 52, respectively. Each of the L-shaped fittings 50 and 52 is firmly threaded at one end onto the trunk hinge 34. Therefore, only a magnetic flux induced by the high-frequency surface currents flowing in the trunk hinge 34 is caught by the internal of the case 46. Any external magnetic flux can positively be shielded by the case 46.

The loop antenna 44 is located along the trunk hinge 34 and preferably shaped to conform to the curvature of the hinge 34.

The circuitry 48 receives power and control signals through a cable 54. High-frequency detection signals from the loop antenna 44 are externally removed through a coaxial cable 56 and then processed by a circuit similar to that used in measuring the distribution of surface currents as aforementioned.

The loop antenna 44 is in the form of a single wound antenna which is located in close proximity with the trunk hinge 34 and electrically insulate from the same. If the loop antenna 44 is in contact with the hinge 34 through the insulation of the antenna, the magnetic flux induced by the surface currents can efficiently be intersected with the loop antenna.

In accordance with the first embodiment of the present invention, surface currents can be detected by the high-frequency pickup at the trunk hinge which was ignored in the prior art. As a result, the antenna system will not entirely be exposed and also can positively receive electromagnetic waves in high frequency bands.

Figure 3:
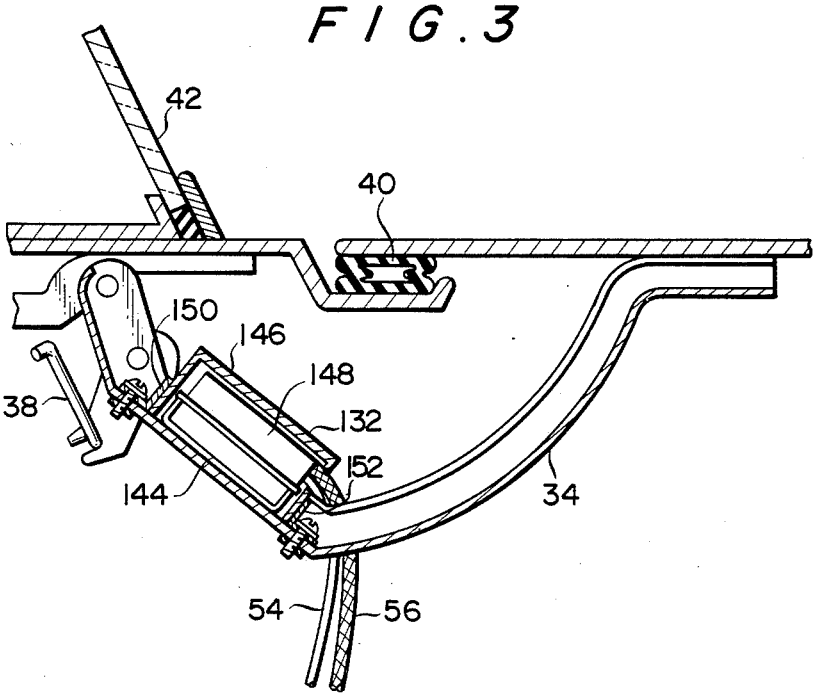
FIG. 3 is a perspective view showing the primary parts of the second embodiment of the present invention in which an electromagnetic coupling type high-frequency pickup is mounted on the inner face of the trunk hinge.

FIG. 3 shows the second embodiment of the present invention which is substantially the same as the first embodiment of FIG. 1 except that a high-frequency pickup is disposed at the inside of the trunk hinge 34. The pickup 132 may be in the form of an electromagnetic coupling type pickup within which a loop antenna 144 and circuitry 148 are mounted. The pickup 132 is firmly mounted on the inner wall of the trunk hinge 34 through L-shaped fittings 150 and 152.

In the second embodiment, the high-frequency pickup 132 will not protrude from the trunk hinge 34 into the trunk room. This is advantageous in that baggage or other objects in the trunk room will not be damaged at all.

Although the present invention has been described as to the use of electromagnetic coupling type pickups, the surface currents can be detected by any other suitable means such as an electrostatic coupling type pickup in accordance with the principle of the present invention.

When it is wanted to use an electrostatic coupling type pickup, detection electrode eeans is arranged along the length of the trunk hinge 34 with an air layer or insulation being located between the trunk hinge 34 and the detection electrode means. Thus, high-frequency surface currents can be removed by the detection electrode means through an electrostatic capacity formed between the surface of the trunk hinge and the detection electrode means. Thus, high-frequency signals can be picked up in the desired frequency bands.

We claim:

1. An automobile antenna system comprising:

a casing having an opening at one side and a portion of said casing being electrostatically shielded;

high-frequency pickup means housed in said casing with a part thereof arranged at a position facing the opening of said casing, for detecting high-frequency surface currents induced on the automobile body by broadcast waves and outputting a signal in response to the detection of the high-frequency surface currents; and mounting means for mounting said casing to a trunk hinge of the automobile body where the high-frequency surface currents concentratedly flow such that said high-frequency pickup means faces the trunk hinge through the opening in said casing.

2. An automobile antenna system as defined in claim 1 wherein said high-frequency pickup means includes a loop antenna mounted in said casing disposed on the trunk hinge and along the length thereof, said loop antenna being adapted to electromagnetically detect a magnetic flux formed by the high-frequency surface currents flowing in said trunk hinge.

3. An automobile antenna system as defined in claim 1 wherein said high frequency pickup means includes detection electrode means arranged in close proximity with the trunk hinge for detecting high-frequency surface currents by electrostatic coupling between the trunk hinge and said detection electrode means.

* * * * *